US011559873B2

(12) United States Patent
Fukushima et al.

(10) Patent No.: US 11,559,873 B2
(45) Date of Patent: Jan. 24, 2023

(54) POLISHING TOOL HOLDER AND POLISHING DEVICE

(71) Applicants: XEBEC TECHNOLOGY CO., LTD., Tokyo (JP); TAIMEI CHEMICALS CO., LTD., Nagano (JP)

(72) Inventors: Keisuke Fukushima, Tokyo (JP); Yoichi Sato, Tokyo (JP)

(73) Assignees: XEBEC TECHNOLOGY CO., LTD., Tokyo (JP); TAIMEI CHEMICALS CO.. LTD., Nagano (JP)

( * ) Notice: Subject to any disclaimer, the term of this patent is extended or adjusted under 35 U.S.C. 154(b) by 330 days.

(21) Appl. No.: 16/766,200

(22) PCT Filed: Jun. 14, 2018

(86) PCT No.: PCT/JP2018/022754
§ 371 (c)(1),
(2) Date: May 21, 2020

(87) PCT Pub. No.: WO2019/138595
PCT Pub. Date: Jul. 18, 2019

(65) Prior Publication Data

US 2020/0368876 A1 Nov. 26, 2020

(30) Foreign Application Priority Data

Jan. 10, 2018 (WO) ..... PCT/JP2018/000340

(51) Int. Cl.
*B24D 13/20* (2006.01)

(52) U.S. Cl.
CPC ..... *B24D 13/20* (2013.01)

(58) Field of Classification Search
CPC ..... B24D 13/145; B24D 13/20
See application file for complete search history.

(56) References Cited

U.S. PATENT DOCUMENTS 3,780,407 A * 12/1973 Hoffecker ..... B24D 13/10 29/90.01
5,932,040 A * 8/1999 Audisio ..... B24D 13/04 156/215

(Continued)

FOREIGN PATENT DOCUMENTS

JP H07-100754 A 4/1995
JP 10-286772 A 10/1998

(Continued)

OTHER PUBLICATIONS

WIPO, International Search Report for International Application No. PCT/JP2018/022754, dated Aug. 7, 2018.

*Primary Examiner* — Omar Flores Sanchez

(57) ABSTRACT

A polishing device (1) includes a polishing brush (3) and a polishing brush holder (4) that holds the polishing brush (3). The polishing brush holder (4) includes a shank (6), a support mechanism (21) that has a sleeve (7) and supports the polishing brush (3) so as to be movable in an axial direction L of the shank (6), and a moving mechanism (22) that moves the polishing brush (3) in the axial direction L. The polishing brush holder (4) includes a pressure sensor (53) that detects a load (sensor detection pressure (P)) applied from a workpiece (W) to the polishing brush (3) when the workpiece (W) is polished by the polishing brush (3) supported by the support mechanism (21), and a control unit (51) that drives the moving mechanism (22) on the basis of the output (sensor detection pressure (P)) from the pressure sensor (53) to move the polishing brush (3) in the axial direction L.

19 Claims, 9 Drawing Sheets

(56) References Cited

U.S. PATENT DOCUMENTS

| | | | | |
|---|---|---|---|---|
| 6,173,470 | B1 * | 1/2001 | van Osenbruggen .. | B24D 13/20 15/179 |
| 2002/0013988 | A1 * | 2/2002 | Kapgan ..... | B24D 13/20 409/140 |
| 2002/0197941 | A1 * | 12/2002 | Bruno ..... | B24D 13/145 451/360 |
| 2008/0289132 | A1 * | 11/2008 | Umbrell ..... | B24D 13/20 15/230.19 |
| 2014/0194038 | A1 * | 7/2014 | Lowe ..... | B24B 9/04 451/57 |
| 2015/0367477 | A1 * | 12/2015 | Hayashi ..... | B24D 13/145 451/103 |
| 2017/0135545 | A1 * | 5/2017 | Taylor ..... | B24D 13/145 |

FOREIGN PATENT DOCUMENTS

| | | | |
|---|---|---|---|
| JP | 2009-50967 | A | 3/2009 |
| JP | 2017-7041 | A | 1/2017 |
| WO | 2015/178273 | A1 | 11/2015 |
| WO | 2016/021460 | A1 | 2/2016 |

* cited by examiner

POLISHING TOOL HOLDER AND POLISHING DEVICE

FIELD

The present invention relates to a polishing tool holder removably holding a polishing tool such as a polishing brush. The present invention also relates to a polishing device in which a polishing tool is held in a polishing tool holder.

BACKGROUND

A polishing device for cutting or polishing a workpiece is described in Patent Literature 1. The polishing device in this literature includes a polishing tool and a polishing tool holder removably holding the polishing tool. The polishing tool is a polishing brush and includes a plurality of wire-shaped grinding elements disposed side by side and a grinding element holder holding one-side ends of the wire-shaped grinding elements. The polishing tool holder includes a shank and a sleeve coaxial to the shank. The polishing brush is held in the polishing tool holder in such a posture that the grinding element holder is fixed in the sleeve and free ends (the other-side ends) of the wire-shaped grinding elements protrude from the sleeve. In cutting or polishing a workpiece, the shank of the polishing device is connected to a spindle of a machine tool. The machine tool turns the polishing device around the axis of the shank and brings the other-side ends of the wire-shaped grinding elements protruding from the sleeve into contact with the workpiece.

CITATION LIST

Patent Literature

Patent Literature 1: Japanese Patent Application Laid-open No. 2009-50967

SUMMARY

Technical Problem

When the wire-shaped grinding elements of the polishing brush become worn during processing on a workpiece by the machine tool with the distance between the spindle and the workpiece kept constant, the position of the free ends of the wire-shaped grinding elements move in a direction away from the workpiece. If the wire-shaped grinding elements are excessively worn, the depth of cut by which the machine tool brings the polishing brush into contact with a workpiece is reduced and it becomes difficult to keep the processing accuracy for the workpiece. In order to solve such a problem, the machine tool may perform processing operation while maintaining the position of the free ends of the wire-shaped grinding elements relative to the workpiece by moving the polishing device in a direction closer to the workpiece as the wire-shaped grinding elements are worn. Unfortunately, to allow the machine tool to perform such control, a control program for controlling the machine tool is complicated.

In view of the foregoing problem, an object of the present invention is to provide a polishing tool holder capable of maintaining the processing accuracy in polishing or cutting a workpiece even when the grinding element of the polishing tool is worn. A polishing device in which a polishing tool is held in such a polishing tool holder is also provided.

Solution to Problem

In order to solve the problem above, the present invention provides a polishing tool holder configured to removably hold a polishing tool having a grinding element holder and a grinding element held in the grinding element holder. The polishing tool holder includes: a shank connected to a machine tool; a support mechanism configured to support the polishing tool movably in an axis direction of the shank; a movement mechanism including a drive source to move the polishing tool in the axis direction; a load detector configured to detect a load exerted on the polishing tool from a workpiece when the polishing tool supported by the support mechanism is polishing the workpiece; and a control unit configured to actuate the movement mechanism based on output from the load detector to move the polishing tool in the axis direction.

According to the present invention, since the polishing tool holder includes a load detector, the load exerted on the polishing brush from the workpiece can be detected during processing operation in which the polishing device connected to the machine tool cuts or polishes the workpiece. The polishing tool holder includes a control unit configured to actuate the movement mechanism based on output from the load detector to move the polishing brush in the axis direction. With this configuration, when the grinding element is excessively worn, the control unit moves the polishing tool in a direction closer to the workpiece so that the depth of cut on the workpiece by the grinding element can be reset. Specifically, when the grinding element becomes excessively worn during processing by the machine tool with the distance between the spindle and the workpiece kept constant, the position of the end of the grinding element in contact with the workpiece moves in a direction away from the workpiece. This reduces the depth of cut by which the machine tool brings the grinding element into contact with the workpiece and therefore reduces the load exerted on the polishing tool from the workpiece. The control unit then actuates the movement mechanism based on output (reduction in load) from the load detector to move the polishing tool in the axis direction in a direction closer to the workpiece, thereby increasing the depth of cut.

According to the present invention, the processing accuracy for the workpiece can be maintained even in such a case where, when the processing starts with the distance between the spindle and the workpiece being kept constant, the distance between the spindle and the workpiece is short to cause excessive processing on the workpiece. For example, when the distance between the spindle and the workpiece is too close, for example, due to a dimension error of the workpiece, the depth of cut by which the machine tool brings the grinding element into contact with the workpiece increases. Consequently, excessive cutting or polishing may be performed on the workpiece. In such a case, the load exerted on the polishing tool from the workpiece increases with the increase in the depth of cut. The control unit then actuates the movement mechanism based on output (increase in load) from the load detector to move the polishing tool in a direction away from the workpiece in the axis direction, whereby the control unit of the polishing tool holder can reduce the depth of cut. This control can maintain the processing accuracy on the workpiece.

In the present invention, it is preferable that when it is determined that the load exerted on the polishing tool from the workpiece becomes lower than a predetermined setting load based on output from the load detector, the control unit actuate the movement mechanism to move the polishing tool in a direction closer to the workpiece. With such a configuration, the polishing tool can be brought closer to the workpiece when the grinding element becomes worn.

In the present invention, it is preferable that when it is determined that the load exerted on the polishing tool from the workpiece becomes higher than a predetermined setting load based on output from the load detector, the control unit actuate the movement mechanism to move the polishing tool in a direction away from the workpiece. With such a configuration, an appropriate depth of cut can be achieved when the depth of cut by which the polishing tool is brought into contact with the workpiece is too large.

In the present invention, it is preferable that the control unit monitor output from the load detector when actuating the movement mechanism and stop actuating the movement mechanism based on the output to stop moving the polishing tool.

In the present invention, the load detector may be a pressure sensor configured to detect a pressure in the axis direction exerted on the polishing tool supported by the support mechanism. Specifically, the machine tool brings the grinding element into contact with the workpiece during processing operation. Accordingly, when the load exerted on the polishing tool from the workpiece changes, the pressure in the axis direction exerted on the polishing tool is changed. The load exerted on the polishing tool from the workpiece during processing operation thus can be detected using a pressure sensor.

In the present invention, the load detector may be a vibration detector configured to detect vibration of the polishing tool supported by the support mechanism. Specifically, the machine tool brings the grinding element into contact with the workpiece during processing operation. Accordingly, when the load exerted on the polishing tool from the workpiece changes, the vibration of the polishing tool changes. The load exerted on the polishing tool from the workpiece thus can be detected using a vibration detector. For example, when the grinding element of the polishing tool becomes excessively worn during processing operation and the position of the end of the grinding element in contact with the workpiece moves in a direction away from the workpiece, the vibration of the polishing tool decreases as the load exerted on the polishing tool from the workpiece decreases. On the other hand, when the movement mechanism is actuated to move the polishing tool in a direction closer to the workpiece in the axis direction, the vibration of the polishing tool increases as the depth of cut increases and the load exerted on the polishing tool from the workpiece increases.

In the present invention, the load detector may be an acoustic wave detector configured to detect an amplitude of sound produced in the polishing tool supported by the support mechanism. Specifically, the machine tool brings the grinding element into contact with the workpiece during processing operation. Accordingly, when the load exerted on the polishing tool from the workpiece changes, the vibration of the polishing tool changes. When the vibration of the polishing tool changes, the amplitude of sound produced in the polishing tool changes. The load exerted on the polishing tool from the workpiece thus can be detected using an acoustic wave detector. For example, when the grinding element of the polishing tool becomes excessively worn during processing operation and the position of the end of the grinding element in contact with the workpiece moves in a direction away from the workpiece, the vibration of the polishing tool decreases as the load exerted on the polishing tool from the workpiece decreases. The amplitude of sound produced in the polishing tool decreases, accordingly. On the other hand, when the movement mechanism is actuated to move the polishing tool in a direction closer to the workpiece in the axis direction, the vibration of the polishing tool increases as the depth of cut increases and the load exerted on the polishing tool from the workpiece increases. The amplitude of sound produced in the polishing tool increases, accordingly.

In the present invention, it is preferable that the polishing tool holder include a counter configured to count a number of times of movement every time the control unit actuates the movement mechanism to move the polishing tool in a direction closer to the workpiece. With such a configuration, the wear state of the grinding element can be grasped based on the number of times of movement. The time for replacement of the polishing tool thus can be easily grasped.

In the present invention, it is preferable that the polishing tool holder include: a first power source configured to supply power to the drive source of the movement mechanism; and a second power source configured to supply power to the control unit. This configuration eliminates the need for externally supplying power to the polishing tool holder. The polishing device therefore can be easily attached to the spindle of the machine tool and rotated.

In the present invention, it is preferable that the polishing tool holder include a wireless communication unit configured to transmit output from the load detector to outside. With this configuration, the state of load exerted on the polishing tool from the workpiece can be monitored from the outside.

In the present invention, it is preferable that the polishing tool holder include: a wireless communication unit configured to perform communication between the control unit; and an external device. With this configuration, control operation by the control unit can be changed from the external device.

In the present invention, the support mechanism may have a joint member to which the grinding element holder is coupled. The joint member may have a through hole passing through in the axis direction. A female screw may be disposed on an inner peripheral surface of the through hole. The movement mechanism may include: a motor serving as the drive source; a shaft member extending so as to pass through the through hole; a drive force-transmitting mechanism configured to transmit rotation of the motor to the shaft member; a male screw disposed on an outer peripheral surface of the shaft member and threaded in the female screw; and a rotation restricting mechanism configured to restrict co-rotation of the joint member and the shaft member. The control unit may be configured to rotate the shaft member by actuation of the motor and move the joint member in the axis direction. With such a configuration, the polishing tool can be moved in the axis direction.

In the present invention, it is preferable that the support mechanism include a guide member configured to guide the joint member in the axis direction on an outer periphery side of the joint member, the guide member have a groove extending in the axis direction, the joint member have a protrusion protruding toward the outer periphery side and disposed in the groove, and the rotation restricting mechanism include: the groove; and the protrusion. With such a configuration, the joint member can be guided in the axis direction by the guide member, and co-rotation of the joint member and the shaft member can be prevented using the guide member. Accordingly, the joint member can be moved accurately in the axis direction when the movement mechanism is actuated.

It is preferable that the guide member be a tubular sleeve extending coaxially to the shank, and the support mechanism support the polishing tool such that the grinding element holder is located inside the sleeve and a part of the grinding element protrudes from the sleeve. With such a configuration, the amount of flexion by which the grinding element is flexed toward the outer periphery can be suppressed by the sleeve, for example, when the polishing tool includes bundles of wire-shaped grinding elements as the grinding element or when the polishing tool includes an elastic grinder as the grinding element.

In the present invention, the movement mechanism may include a support member configured to support the shaft member movably in the axis direction and rotatably around the axis. The support member may be located between the joint member and the drive force-transmitting mechanism in the axis direction. The drive force-transmitting mechanism may include: a final gear configured to rotate around a rotation axis parallel to the shaft member; a driving force of the motor being transmitted to the final gear; an output gear fixed coaxially to the shaft member and meshed with the final gear; and a biasing member configured to bias the output gear toward the support member. The pressure sensor may be in contact with the shaft member from the axis direction to detect a pressure exerted on the shaft member. With such a configuration, when the joint member moves in the axis direction due to change in load exerted on the polishing tool from the workpiece, the shaft member moves in the axis direction. Accordingly, the load exerted on the polishing tool from the workpiece can be detected by the pressure sensor that is in contact with the shaft member from the axis direction to detect a pressure exerted on the shaft member. Since the rotation axes of the final gear and the shaft member to which the output gear is fixed are parallel, the meshing between the output gear and the final gear is not released by the movement of the shaft member in the axis direction, and rotation of the motor is transmitted to the shaft member through the drive force-transmitting mechanism.

A polishing device in the present invention includes: the polishing tool holder described above; and the polishing tool. The grinding element includes a plurality of wire-shaped grinding elements disposed side by side with a length direction oriented in the axis direction. The grinding element holder holds one-side ends in the axis direction of the wire-shaped grinding elements. The polishing tool is held in the polishing tool holder and brings the other-side ends of the wire-shaped grinding elements into contact with a workpiece to polish the workpiece.

In the polishing device according to the present invention, since the polishing tool holder includes a load detector, the load exerted on the polishing tool from the workpiece can be detected during processing operation in which the polishing device connected to the machine tool cuts or polishes the workpiece. The polishing tool holder includes a control unit configured to actuate the movement mechanism based on output from the load detector to move the polishing tool in the axis direction. Accordingly, when the wire-shaped grinding elements are excessively worn and the load exerted on the polishing tool is reduced, the polishing tool holder can bring the polishing tool closer to the workpiece to reset the depth of cut on the workpiece by the polishing tool to the previous state. In addition, when the distance between the spindle and the workpiece becomes close and the load exerted on the polishing tool is increased during processing with the distance between the spindle and the workpiece kept constant, the polishing tool holder can bring the polishing tool away from the workpiece to reduce the depth of cut on the workpiece by the polishing tool. This control can maintain the processing accuracy for the workpiece. In the polishing device according to the present invention, the polishing tool includes a plurality of wire-shaped grinding elements as the grinding element. Here, since the wire-shaped grinding elements are flexible, breakage of the grinding elements of the polishing tool can be prevented or suppressed when the polishing tool holder moves the polishing tool in a direction closer to the workpiece to increase the depth of cut on the workpiece.

A polishing device according to another aspect of the present invention includes: the polishing tool holder described above; and the polishing tool. The grinding element is an elastic grinder. The grinding element holder holds a one-side end in the axis direction of the elastic grinder. The polishing tool is held in the polishing tool holder and brings the other-side end of the elastic grinder into contact with a workpiece to polish the workpiece.

In the polishing device according to the present invention, since the polishing tool holder includes a load detector, the load exerted on the polishing tool from the workpiece can be detected during processing operation in which the polishing device connected to the machine tool cuts or polishes the workpiece. The polishing tool holder includes a control unit configured to actuate the movement mechanism based on output from the load detector to move the polishing tool in the axis direction. Accordingly, when the grinding element is excessively worn and the load exerted on the polishing tool is reduced, the polishing tool holder can bring the polishing tool closer to the workpiece to reset the depth of cut on the workpiece by the polishing tool to the previous state. In addition, when the distance between the spindle and the workpiece becomes close and the load exerted on the polishing tool is increased during processing with the distance between the spindle and the workpiece kept constant, the polishing tool holder can bring the polishing tool away from the workpiece to reduce the depth of cut on the workpiece by the polishing tool. This control can maintain the processing accuracy for the workpiece. Here, the grinding element of the polishing tool has elasticity. Accordingly, breakage of the grinding element of the polishing tool can be prevented or suppressed when the polishing tool holder moves the polishing tool in a direction closer to the workpiece to increase the depth of cut on the workpiece.

In the present invention, the elastic grinder may include: an elastic foam; a polymer; and abrasive grains.

A polishing device according to yet another aspect of the present invention includes: the polishing tool holder described above; and the polishing tool. The grinding element is a grinder. The grinding element holder holds a one-side end in the axis direction of the grinding element. The polishing tool is held in the polishing tool holder and brings the other-side end of the grinding element into contact with a workpiece to polish the workpiece.

According to the present invention, since the polishing tool holder of the polishing device includes a load detector, the load exerted on the polishing tool from the workpiece can be detected during processing operation in which the polishing device connected to the machine tool cuts or polishes the workpiece. The polishing tool holder of the polishing device includes a control unit configured to actuate the movement mechanism based on output from the load detector to move the polishing tool in the axis direction. Accordingly, when the grinding element is excessively worn and the load exerted on the polishing tool is reduced, the polishing tool holder can bring the polishing tool closer to the workpiece to reset the depth of cut on the workpiece by the polishing tool to the previous state. In addition, when the distance between the spindle and the workpiece becomes close and the load exerted on the polishing tool is increased during processing with the distance between the spindle and the workpiece kept constant, the polishing tool holder can bring the polishing tool away from the workpiece to reduce the depth of cut on the workpiece by the polishing tool. This control can maintain the processing accuracy on the workpiece.

DESCRIPTION OF EMBODIMENTS

A polishing device that is an embodiment of the present invention will be described below with reference to the drawings.

First Embodiment

Figure 1:
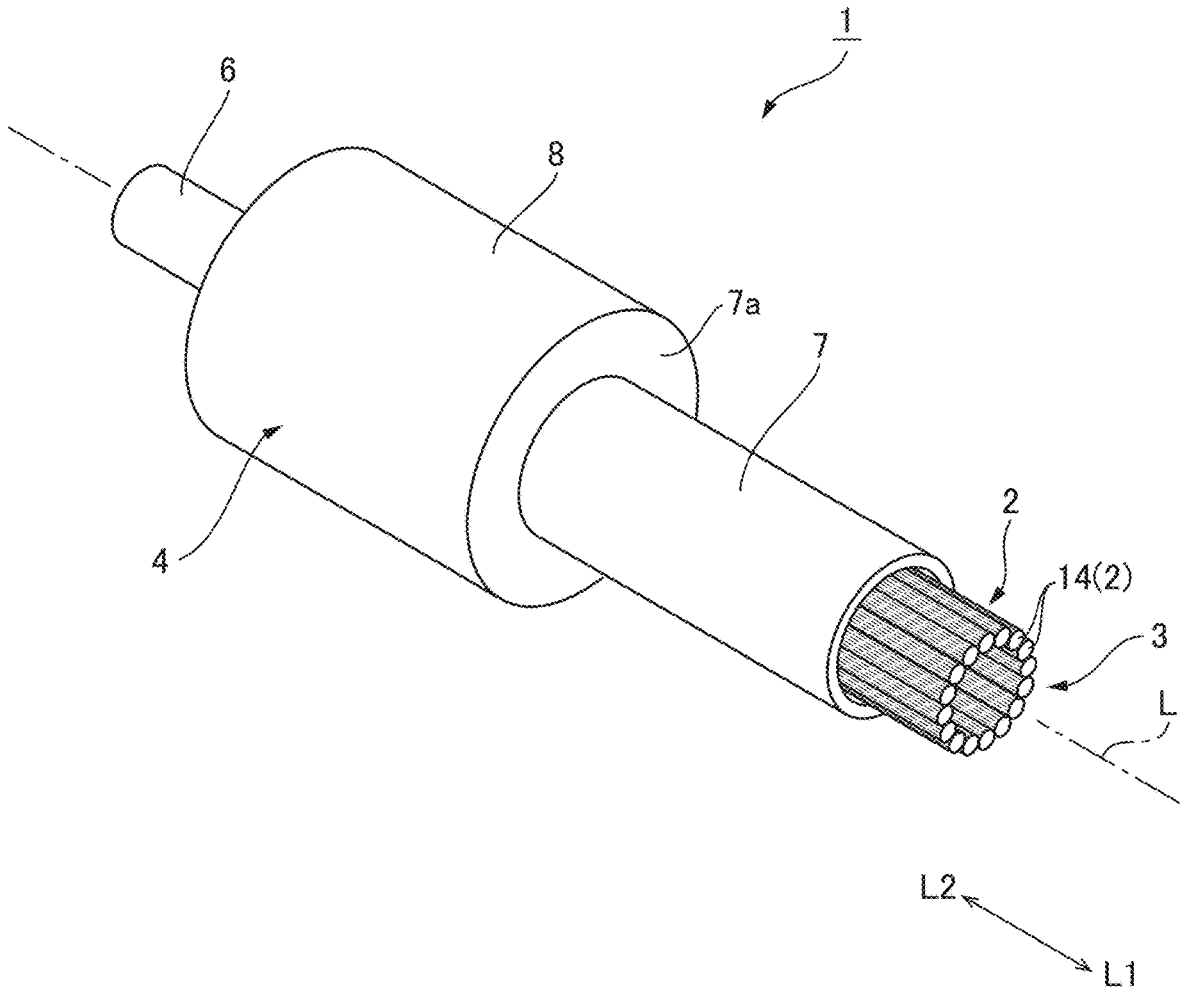
FIG. 1 is a perspective view of a polishing device in a first embodiment to which the present invention is applied.

FIG. 1 is an external perspective view of a polishing device to which the present invention is applied. As illustrated in FIG. 1, a polishing device 1 includes a polishing brush 3 (polishing tool) having a plurality of wire-shaped grinding elements 2 (grinding element) and a polishing brush holder 4 (polishing tool holder) removably holding the polishing brush 3. The polishing brush holder 4 has a shank 6 connected to a machine tool 5 and a sleeve 7 coaxial to the shank 6. Between the shank 6 and the sleeve 7, a large diameter portion 8 is provided, which has a larger diameter compared with the shank 6 and the sleeve 7. The polishing brush 3 is held in the polishing brush holder 4 such that the ends of the wire-shaped grinding elements 2 protrude from the sleeve 7.

The polishing device 1 is connected to a spindle 5*a* (see FIG. 4) of the machine tool 5 at the shank 6 of the polishing brush holder 4. The machine tool 5 rotates the polishing device 1 around the axis L of the shank 6. The machine tool 5 brings the ends of the wire-shaped grinding elements 2 protruding from the sleeve 7 into contact with a workpiece W to cut or polish the workpiece W. In the following description, the axis L direction of the shank 6 is considered as the axis L direction of the polishing device 1. In the axis L direction, the side on which the sleeve 7 is located is considered as the front side L1 of the polishing device 1, and the side on which the shank 6 is located is considered as the back side L2 of the polishing device 1.

(Polishing Brush)

Figure 2:
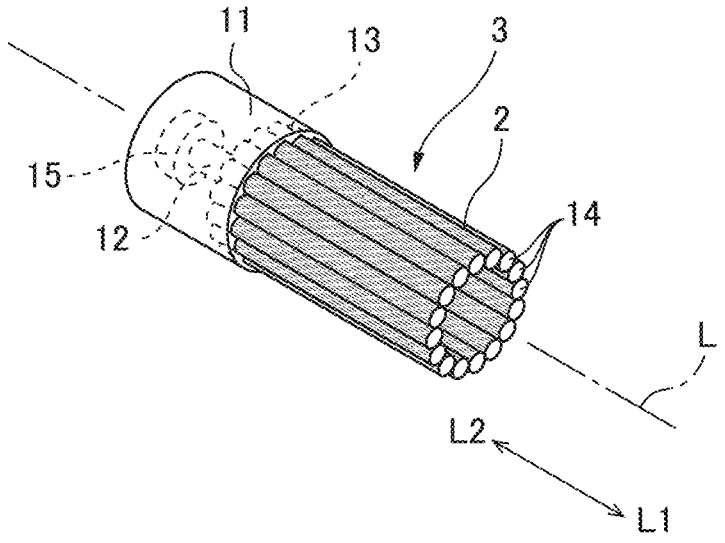
FIG. 2 is a perspective view of a polishing brush that is a polishing tool of the polishing device in the first embodiment.
Figure 3:
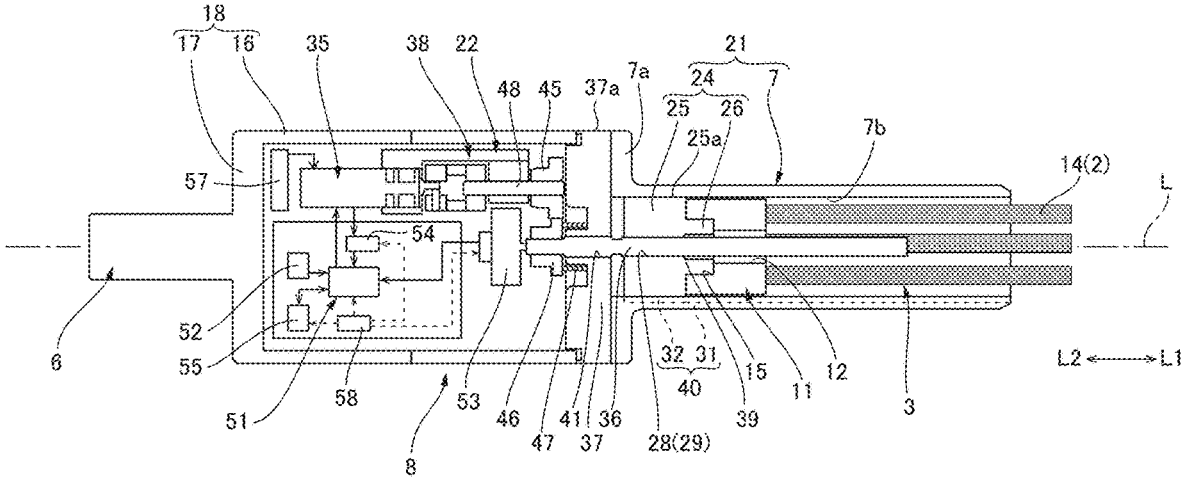
FIG. 3 is an illustration of an overall structure of the polishing device in FIG. 1.

FIG. 2 is a perspective view of the polishing brush 3 of the polishing device 1. FIG. 3 is an illustration of an overall structure of the polishing device 1 in FIG. 1. In FIG. 3, the polishing device 1 is cut along the axis L.

As illustrated in FIG. 2, the polishing brush 3 has a plurality of wire-shaped grinding elements 2 disposed side by side and a grinding element holder 11 holding one-side ends of these wire-shaped grinding elements 2. "A plurality of wire-shaped grinding elements 2 disposed side by side" refers to a state in which the length direction of each wire-shaped grinding element 2 is arranged in parallel or substantially in parallel in a plurality of wire-shaped grinding elements 2. The wire-shaped grinding element 2 is formed by impregnating and solidifying an assembly of inorganic filaments such as alumina filaments with a binder resin. As illustrated in FIG. 3, the grinding element holder 11 is an annular member having a holder through hole 12 extending in the axis L direction. As illustrated in FIG. 2, the grinding element holder 11 has a plurality of wire-shaped grinding element-holding holes 13 on its front surface. Each wire-shaped grinding element-holding hole 13 is circular. A plurality of wire-shaped grinding element-holding holes 13 are provided at equiangular intervals around the axis L to surround the holder through hole 12.

A plurality of wire-shaped grinding elements 2 are divided into bundles of a plurality of elements. Each grinding element bundle 14 in a bound state is inserted in the wire-shaped grinding element-holding hole 13 at its back end (one-side end). The grinding element bundles 14 are fixed to the grinding element holder 11 by adhesive filled in the wire-shaped grinding element-holding holes 13. As illustrated in FIG. 3, the grinding element holder 11 has a recess surrounding the holder through hole 12 at its back end surface. The recess is a brush-side joint portion 15 (polishing tool-side joint portion) for removably attaching the polishing brush 3 to the polishing brush holder 4.

(Polishing Brush Holder)

As illustrated in FIG. 3, the polishing brush holder 4 includes the shank 6, a support mechanism 21 supporting the polishing brush 3 movably in the axis L direction, and a movement mechanism 22 for moving the polishing brush 3 in the axis L direction.

The support mechanism 21 includes the sleeve 7 and a joint member 24 disposed in the sleeve 7 so as to be movable in the axis L direction. The sleeve 7 is tubular. At the back end thereof, a flange 7*a* extending toward the outer periphery is provided. The flange 7*a* defines the front end surface of the large diameter portion 8.

The joint member 24 includes a disc portion 25 having an annular facing surface 25*a* facing an inner peripheral surface 7*b* of the sleeve 7 with a slight gap and a protrusion 26 protruding from the center of the disc portion 25 to the front side L1. The protrusion 26 is a joint portion having a shape fitted in the brush-side joint portion 15 of the polishing brush 3. The polishing brush 3 has the brush-side joint portion 15 fitted to a joint portion (protrusion 26) of the joint member 24 and thereby is removably attached to the polishing brush holder 4. In a state in which the polishing brush 3 is coupled to the joint member 24, the polishing brush 3 and the joint member 24 are integrated and they do not make relative rotation around the axis L. The joint member 24 has a through hole 28 passing through in the axis L direction. A female screw 29 is provided on the inner peripheral surface of the through hole 28.

The polishing brush 3 is attached to the joint member 24 and thereby supported by the support mechanism 21 so as to be movable in the axis L direction. The polishing brush 3 is supported by the support mechanism 21 in such a posture that the grinding element holder 11 is located inside the sleeve 7 and the other-side front ends (the other-side ends, free ends) of a plurality of wire-shaped grinding elements 2 protrude from the sleeve 7. When the polishing brush 3 is attached to the joint member 24, the through hole 28 of the joint member 24 is communicatively connected to the holder through hole 12. The inner diameter size of the holder through hole 12 is larger than the inner diameter size of the through hole 28 of the joint member 24.

Here, the sleeve 7 has a groove 31 extending in the axis L direction on its inner peripheral surface 7*b*. The joint member 24 has a protrusion 32 at a portion in the circumferential direction of the annular facing surface 25*a*. The protrusion 32 protrudes toward the outer periphery and extends in the axis L direction. The joint member 24 is disposed inside the sleeve 7 with the protrusion 32 inserted in the groove 31 of the sleeve 7. When the joint member 24 moves in the axis L direction, the joint member 24 is guided along the groove 31. The sleeve 7 is therefore a guide member for guiding the joint member 24 in the axis L direction. The groove 31 may be provided in the sleeve 7 as an elongated hole passing through in the radial direction and extending in the axis L direction.

The movement mechanism 22 includes a motor 35 as a drive source. In the present embodiment, the motor 35 is a stepping motor. The movement mechanism 22 also includes a shaft member 36 extending in the axis L direction, a support member 37 supporting the shaft member 36 movably in the axis L direction and rotatably around the axis L, a drive force-transmitting mechanism 38 for transmitting the rotation of the motor 35 to the shaft member 36, a male screw 39 provided on the outer peripheral surface of the shaft member 36, and a rotation restricting mechanism 40 for restricting co-rotation of the joint member 24 and the shaft member 36 around the axis L. The support member 37 is a disc-shaped member extending in a direction orthogonal to the axis L.

Here, the large diameter portion 8 includes a housing 18 having a tubular portion 16 and a closure portion 17 closing the back-end opening of the tubular portion 16. The shank 6 protrudes from the center of the closure portion 17 to the back side L2. The support member 37 closes the front-end opening of the tubular portion 16. An annular outer peripheral surface 37*a* located on the outside in the radial direction orthogonal to the axis L in the support member 37 forms an outer peripheral surface of the large diameter portion 8 together with the outer peripheral surface of the tubular portion 16. The motor 35 and the drive force-transmitting mechanism 38 are disposed in a space inside the large diameter portion 8 that is defined by the housing 18 and the support member 37.

The support member 37 is located between the drive force-transmitting mechanism 38 and the joint member 24 in the axis L direction. At the center of the support member 37, a bore 41 for supporting the shaft member 36 passes through in the axis L direction. The front surface of the support member 37 is fixed to the flange 7*a* of the sleeve 7. The shaft member 36 passes through the bore 41 and also passes through the through hole 28 of the joint member 24 disposed inside the sleeve 7. The shaft member 36 passes through the holder through hole 12 of the polishing brush 3 attached to the joint member 24 and extends to the front side L1. The male screw 39 of the shaft member 36 is threaded in the female screw 29 of through hole 28 in the joint member 24. The groove 31 provided on the inner peripheral surface 7*b* of the sleeve 7 and the protrusion 32 provided on the outer peripheral surface of the joint member 24 constitute the rotation restricting mechanism 40.

The drive force-transmitting mechanism 38 includes a final gear 45 to which the drive force of the motor 35 is transmitted, an output gear 46 coaxially fixed to the shaft member 36 and meshing with the final gear 45, and a biasing member 47 biasing the output gear 46 toward the support member 37. The final gear 45 is rotatably supported by a support shaft 48 extending from the support member 37 to the back side L2. The support shaft 48 is parallel to the shaft member 36. The final gear 45 and the output gear 46 fixed to the shaft member 36 therefore rotate around the rotation axes parallel to each other. The output gear 46 abuts on the support member 37 from the back side L2 by the biasing force of the biasing member 47.

When the shaft member 36 moves to the back side L2, the output gear 46 fixed to the shaft member 36 moves to the back side L2 against the biasing force of the biasing member 47. Thus, when the shaft member 36 is moving to the back side L2, the shaft member 36 is moving against the biasing force of the biasing member 47. When the shaft member 36 moves to the back side L2, the output gear 46 is spaced apart from the support member 37 to the back side L2.

Here, the rotation axes of the final gear 45 and the shaft member 36 to which the output gear 46 is fixed are parallel. Thus, even when the output gear 46 moves in the axis L direction, the meshed state of the output gear 46 and the final gear 45 is kept. With this configuration, the rotation of the motor 35 is always transmitted to the output gear 46 through the drive force-transmitting mechanism 38. When the drive force of the motor 35 is transmitted to the output gear 46, the shaft member 36 rotates around the axis L.

(Control System)

As illustrated in FIG. 3, the control system of the polishing brush holder 4 includes a control unit 51 including a CPU and a nonvolatile memory 52 connected to the control unit 51. A control program running on the control unit 51 is stored and held in the nonvolatile memory 52. The control unit 51 runs the control program to control the movement of the polishing brush 3.

A pressure sensor 53 is connected to the input side of the control unit 51. The pressure sensor 53 is a load detector for detecting a load exerted on the polishing brush 3 from a workpiece W when the polishing brush 3 is polishing the workpiece W. The pressure sensor 53 is in contact with the shaft member 36 from the back side L2 to detect a pressure exerted on the shaft member 36. The motor 35 is connected to the output side of the control unit 51.

When it is determined that the output (sensor detection pressure P) from the pressure sensor 53 becomes lower than a predetermined first pressure threshold, the control unit 51 actuates the motor 35 to move the polishing brush 3 to the front side L1. When it is determined that the output (sensor detection pressure P) from the pressure sensor 53 becomes higher than a predetermined second pressure threshold, the control unit 51 actuates the motor 35 to move the polishing brush 3 to the back side L2. Further, the control unit 51 monitors the output (sensor detection pressure P) from the pressure sensor 53 when actuating the motor 35 to move the polishing brush 3 and stops actuating the motor 35 based on the monitored output to stop moving the polishing brush 3.

Connected to the control unit 51 are a counter 54 for counting the number of times of movement every time the control unit 51 actuates the motor 35 (movement mechanism 22) to move the polishing brush 3 to the front side L1, and a wireless communication unit 55 performing communication between the control unit 51 and an external device. The counter 54 counts the drive steps input to the motor 35 for moving the polishing brush 3 to the front side L1 and inputs the count as the number of times of movement to the control unit 51. The counter 54 may be configured as a part of the control unit 51. In this case, the counter 54 counts the number of times of movement every time the control unit 51 inputs a drive signal for moving the polishing brush 3 to the front side L1 to the motor 35.

The wireless communication unit 55 performs communication between an external device and the control unit 51 through a wireless network defined by, for example, IEEE802.11 standards. The control unit 51 transmits the output (sensor detection pressure P: see FIG. 6) from the pressure sensor 53 to an external device through the wireless communication unit 55. The control unit 51 transmits the number of times of movement of the polishing brush 3 counted by the counter 54 to an external device through the wireless communication unit 55. The external device can rewrite the control program stored and held in the nonvolatile memory 52 through a wireless network and the wireless communication unit 55.

Here, the polishing brush holder 4 includes a motor battery 57 (first power source) supplying power to the motor 35 that is a drive source of the movement mechanism 22. The polishing brush holder 4 further includes a control battery 58 (second power source) supplying power to the control unit 51, the pressure sensor 53, the counter 54, and the wireless communication unit 55. The motor battery 57 and the control battery 58 can be externally charged through a cable. The control unit 51, the nonvolatile memory 52, the counter 54, the wireless communication unit 55, the motor battery 57, and the control battery 58 are disposed in a space inside the large diameter portion 8 that is defined by the housing 18 and the support member 37.

(Control Operation)

Figure 4:
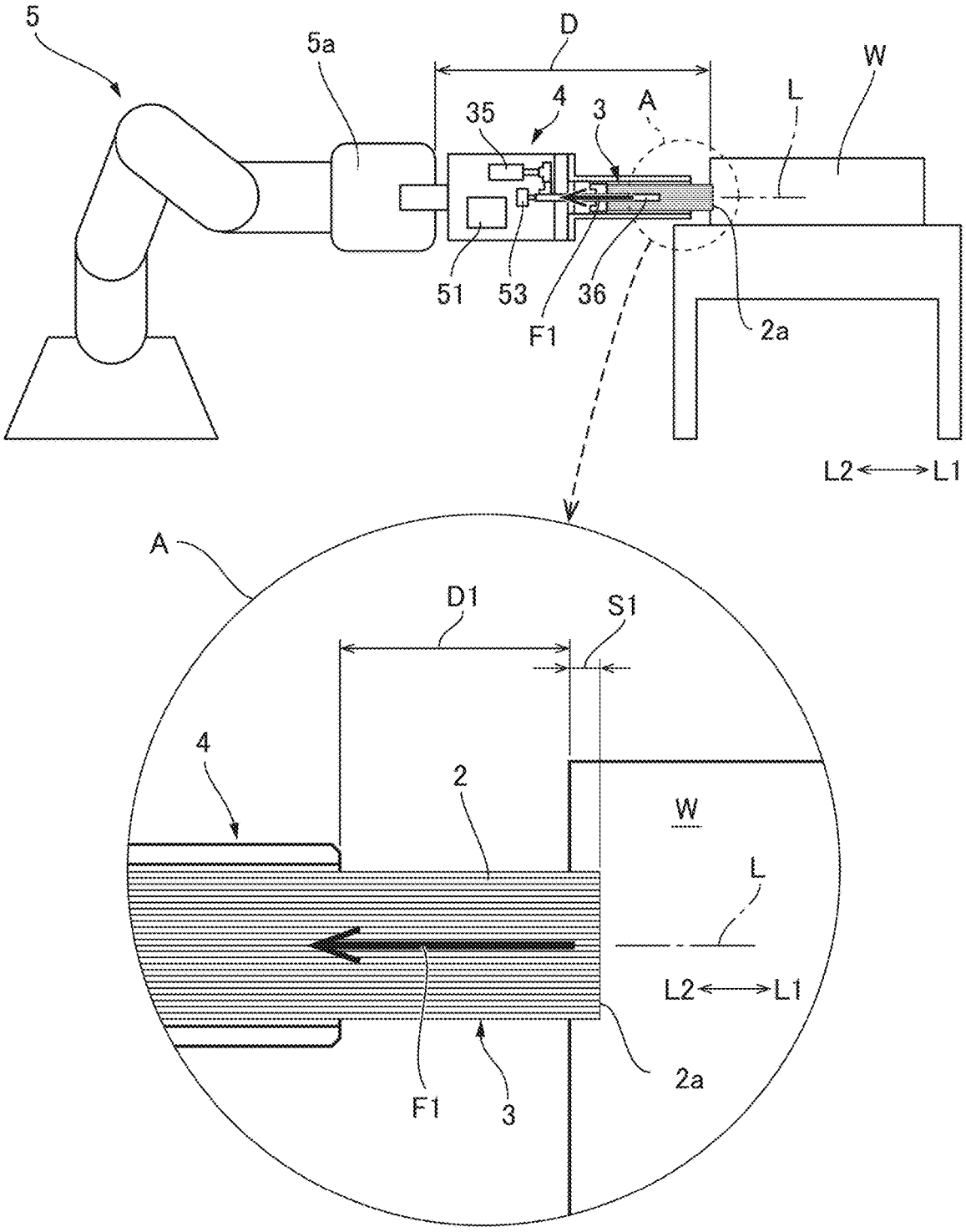
FIG. 4 is an illustration of a control operation in which a control unit controls movement of the polishing brush.
Figure 5:
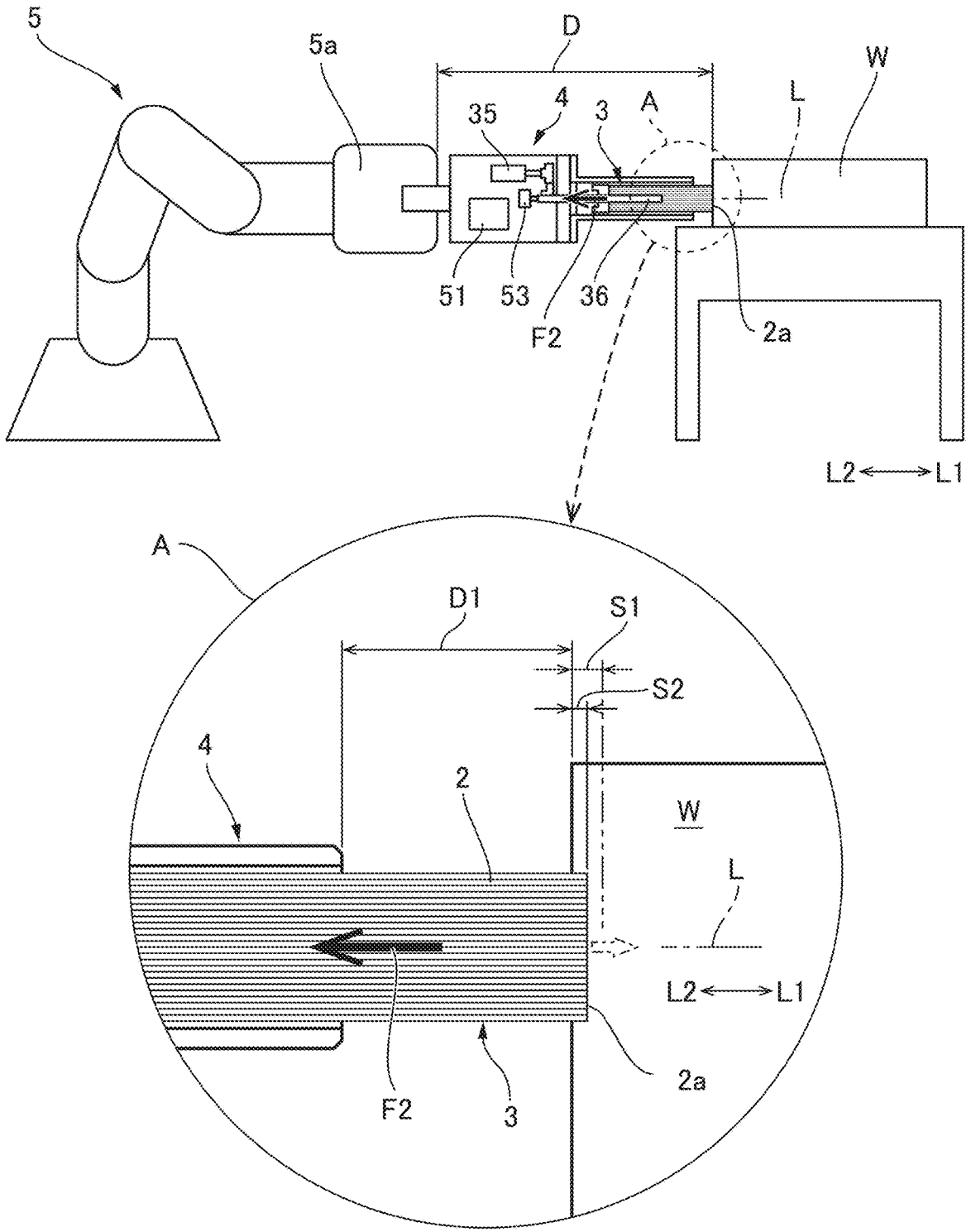
FIG. 5 is an illustration of a control operation in which the control unit controls movement of the polishing brush.
Figure 6:
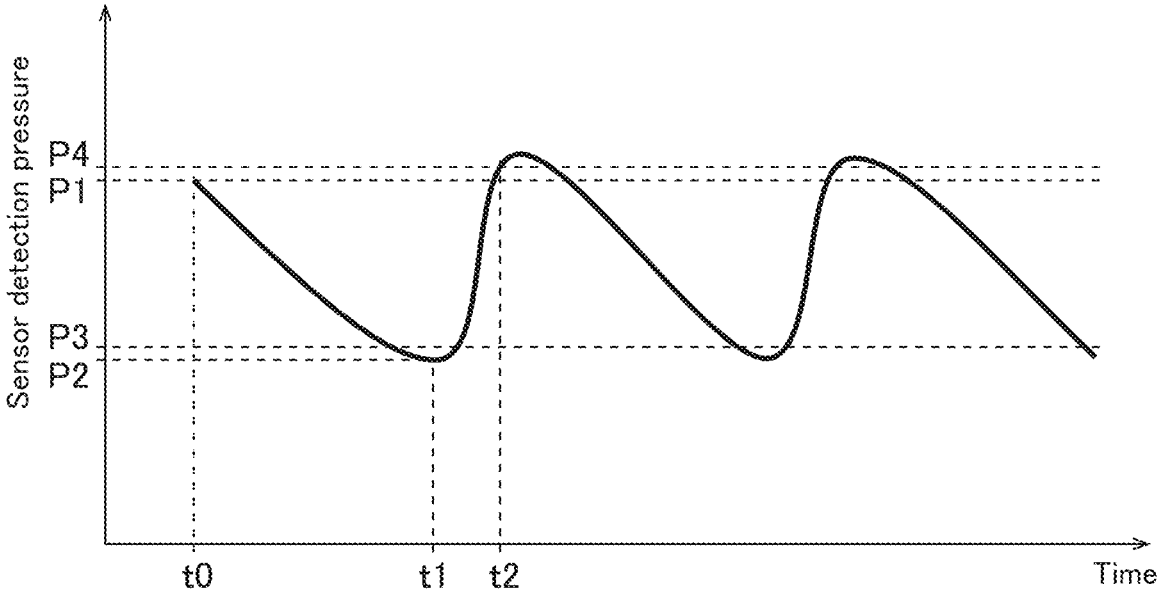
FIG. 6 is a graph of sensor detection pressure output from a pressure sensor during processing operation.

The control operation in which the control unit 51 moves the polishing brush 3 held in the polishing brush holder 4 during processing operation of cutting or polishing a workpiece W by the polishing device 1 will now be described. The control unit 51 actuates the motor 35 (movement mechanism 22) based on the output (sensor detection pressure P) from the pressure sensor 53 to move the polishing brush 3 in the axis L direction. FIG. 4 and FIG. 5 are illustrations of the processing operation. FIG. 6 is a graph illustrating sensor detection pressure P output from the pressure sensor 53 during processing operation. In FIG. 4 and FIG. 5, the upper diagram illustrates a state in which the polishing device 1 is connected to the machine tool 5 and processing the workpiece W. In FIG. 4 and FIG. 5, the lower diagram is a partially enlarged view of a range A surrounded by a dotted line in the upper diagram. FIG. 4 illustrates a state in which the depth of cut by which the machine tool 5 brings the wire-shaped grinding element 2 into contact with the workpiece W is appropriate during the processing operation. FIG. 5 illustrates a state in which the wire-shaped grinding element 2 is worn during processing operation and the depth of cut by which the machine tool 5 brings the wire-shaped grinding element 2 into contact with the workpiece W is reduced.

In the present embodiment, as illustrated in FIG. 4 and FIG. 5, the machine tool 5 processes the workpiece W by bringing the free end of the wire-shaped grinding element 2 of the polishing brush 3 into contact with the workpiece W, with a distance D between the spindle 5*a* and the workpiece W being kept constant. In other words, the machine tool 5 processes the workpiece W by bringing the free end of the wire-shaped grinding element 2 of the polishing brush 3 into contact with the workpiece W, with a distance D1 between a front end 7*c* of the sleeve 7 of the polishing device 1 and the workpiece W being kept constant.

As illustrated in FIG. 4, during processing operation, in a state in which the depth of cut S1 by which the machine tool 5 brings the wire-shaped grinding element 2 into contact with the workpiece W is appropriate, the shaft member 36 is moving to the back side L2 against the biasing force of the biasing member 47. That is, during processing operation, load (pressure F1) is exerted on the polishing brush 3 from the workpiece W. This load (pressure F1) is transmitted to the shaft member 36 through the joint member 24. The shaft member 36 therefore is moving to the back side L2 against the biasing force of the biasing member 47 biasing the output gear 46. As illustrated at a point of time t0 in FIG. 6, the pressure sensor 53 detects a sensor detection pressure P1 corresponding to the load (pressure F1) exerted on the polishing brush 3 from the workpiece W. Here, the sensor detection pressure P1 corresponds to the difference between the pressure F1 and the biasing force by the biasing member 47. In a state in which the shaft member 36 has moved to the back side L2, the output gear 46 fixed to the shaft member 36 is spaced apart from the support member 37 to the back side L2.

Then, when the wire-shaped grinding element 2 is worn, as illustrated in FIG. 5, the position of a front end 2*a* of the wire-shaped grinding element 2 moves in a direction away from the workpiece W, so that the depth of cut S1 by which the machine tool 5 brings the wire-shaped grinding element 2 into contact with the workpiece W is reduced to the depth of cut S2. As a result, the load exerted on the polishing brush 3 from the workpiece W becomes pressure F2 smaller than pressure F1. The pressure sensor 53 then detects a sensor detection pressure P2 corresponding to the load (pressure F2) exerted on the polishing brush 3 from the workpiece W, as illustrated at a point of time t1 in FIG. 6.

Here, when it is determined that the output (sensor detection pressure P2) from the pressure sensor 53 becomes lower than a predetermined first pressure threshold P3, the control unit 51 actuates the motor 35 to move the polishing brush 3 to the front side L1 (see the arrow of chain double-dashed line in FIG. 5). In other words, when it is determined that pressure F2 exerted on the polishing brush 3 from the workpiece W becomes lower than a predetermined setting load based on the output (sensor detection pressure P) from the pressure sensor 53, the control unit 51 actuates the motor 35 to move the polishing brush 3 to the front side L1.

Then, the control unit 51 monitors the output (sensor detection pressure P) from the pressure sensor 53 when actuating the motor 35 to move the polishing brush 3 and stops actuating the motor 35 based on the monitored output to stop moving the polishing brush 3. This control makes the depth of cut S2 closer to the depth of cut S as illustrated in FIG. 4 to maintain the processing accuracy of the polishing device 1 for the workpiece W.

In the present embodiment, the control unit 51 monitors the output (sensor detection pressure P) from the pressure sensor 53 when actuating the motor 35 to move the polishing brush 3 and stops actuating the motor 35 based on the monitored output, so that the processing accuracy of the polishing device 1 can be maintained even when the processing performance of the polishing brush 3 cutting or polishing a workpiece W is changed due to change in the total length of the wire-shaped grinding element 2 due to wear.

That is, when the wire-shaped grinding element 2 is less worn and the total length of the wire-shaped grinding element 2 is long, the resilience of the wire-shaped grinding element 2 is weak and the processing performance of the polishing brush 3 is low. The pressure (load) exerted on the polishing brush 3 from the workpiece W is therefore small at the initial point of time when the polishing brush 3 is brought closer to the workpiece W. The control unit 51 monitors the output (sensor detection pressure P) from the pressure sensor 53 during movement of the polishing brush 3 and stops moving the polishing brush 3 (stops the actuation of the motor 35) at a point of time t2 when the sensor detection pressure P is a predetermined sensor detection pressure P4 as illustrated in FIG. 6, whereby the amount of movement of the polishing brush 3 is increased. When the amount of movement of the polishing brush 3 is increased, the depth of cut by which the machine tool 5 brings the polishing brush 3 into contact with the workpiece W is increased, so that the processing accuracy of the polishing brush 3 processing the workpiece W can be maintained even when the resilience of the wire-shaped grinding element 2 is weak.

On the other hand, when the wire-shaped grinding element 2 is worn and the total length of the wire-shaped grinding element 2 becomes short, the resilience of the wire-shaped grinding element 2 is strong and the processing performance of the polishing brush 3 is increased. The pressure (load) exerted on the polishing brush 3 from the workpiece W is therefore large from the initial point of time when the polishing brush 3 is brought closer to the workpiece W. The control unit 51 monitors the output (sensor detection pressure P) from the pressure sensor 53 during movement of the polishing brush 3 and stops moving the polishing brush 3 (stops the actuation of the motor 35) at a point of time t2 when the sensor detection pressure P is a predetermined sensor detection pressure P4 as illustrated in FIG. 6, whereby the amount of movement of the polishing brush 3 is reduced. When the amount of movement of the polishing brush 3 is reduced, the depth of cut by which the machine tool 5 brings the polishing brush 3 into contact with the workpiece W is reduced, so that the processing accuracy of the polishing brush 3 processing the workpiece W can be maintained even when the resilience of the wire-shaped grinding element 2 is strong.

According to the present embodiment, the processing accuracy for the workpiece W can be maintained even in such a case where, when the processing starts with the distance D between the spindle 5*a* and the workpiece W being kept constant, the distance D between the spindle 5*a* and the workpiece W is short, for example, due to a dimension error of the workpiece W to cause excessive processing on the workpiece W.

That is, when the distance D between the spindle 5*a* and the workpiece W is too close to each other, the depth of cut by which the machine tool 5 brings the wire-shaped grinding element 2 into contact with the workpiece W is increased, possibly causing excessive cutting or polishing on the workpiece W. In such a case, the depth of cut by which the wire-shaped grinding element 2 is brought into contact with the workpiece W increases and the load (pressure) exerted on the polishing brush 3 from the workpiece W increases. The control unit 51 then actuates the motor 35 based on the output (sensor detection pressure P) from the pressure sensor 53 to move the polishing brush 3 to the back side L2. That is, when it is determined that the output (sensor detection pressure P) from the pressure sensor 53 becomes higher than a predetermined second pressure threshold (sensor detection pressure P), the control unit 51 actuates the motor 35 to move the polishing brush 3 to the back side L2.

Here, when the polishing brush 3 moves to the back side L2, the load (pressure) exerted on the polishing brush 3 from the workpiece W decreases as the distance of the polishing brush 3 from the workpiece W increases. The control unit 51 monitors the output (sensor detection pressure P) from the pressure sensor 53 during movement of the polishing brush 3 and, when the sensor detection pressure P1 reaches a predetermined sensor detection pressure P4, stops moving the polishing brush 3, whereby an appropriate depth of cut by which the machine tool 5 brings the polishing brush 3 into contact with the workpiece W is achieved. This control can maintain the processing accuracy of the polishing brush 3 processing the workpiece W.

According to the present embodiment, the machine tool 5 need not move the spindle 5*a* in a direction closer to the workpiece W in order to maintain the processing accuracy when the wire-shaped grinding element 2 of the polishing brush 3 is worn and short. That is, according to the present embodiment, the machine tool 5 can maintain the processing posture by keeping the distance D between the spindle 5*a* and the workpiece W constant during processing operation.

(Operation Effects)

According to the present embodiment, since the polishing brush holder 4 includes the pressure sensor 53, the load (pressure) exerted on the polishing brush 3 from the workpiece W can be detected during processing operation in which the polishing device 1 connected to the machine tool 5 cuts or polishes the workpiece W. The control unit 51 of the polishing brush holder 4 actuates the movement mechanism 22 based on the output (sensor detection pressure P) from the pressure sensor 53 to move the polishing brush 3 in the axis L direction. With this configuration, even when the wire-shaped grinding element 2 of the polishing brush 3 is worn, the polishing device 1 can maintain the processing accuracy in polishing or cutting the workpiece W. It is therefore unnecessary to allow the machine tool 5 to perform complicated control operation such as moving the polishing device 1 in a direction closer to the workpiece W as the wire-shaped grinding element 2 is worn. Accordingly, complication of the control program for controlling the machine tool 5 can be avoided. According to the present embodiment, the processing accuracy for the workpiece W can be maintained even in such a case where, when the processing starts with the distance D between the spindle 5*a* and the workpiece W being kept constant, the distance D between the spindle 5*a* and the workpiece W is short, for example, due to a dimension error of the workpiece W to cause excessive processing on the workpiece W.

In the present embodiment, the grinding element of the polishing tool includes a plurality of wire-shaped grinding elements 14. Here, since the wire-shaped grinding elements 14 are flexible, breakage of the grinding elements of the polishing tool can be prevented or suppressed when the polishing brush holder 4 moves the polishing brush 3 in a direction closer to the workpiece W to increase the depth of cut on the workpiece W.

According to the present embodiment, the machine tool 5 can keep the distance D between the spindle 5*a* and the workpiece W constant during processing operation and therefore can maintain its processing posture. The machine tool 5 therefore can process the workpiece W without being affected by the static accuracy of the machine tool 5. Accordingly, in the processing operation in which the machine tool 5 having the polishing device 1 attached thereto processes the workpiece W, the processing operation can be easily kept constant from the start to the end of the processing operation.

Here, the machine tool 5 keeps the distance D between the spindle 5*a* and the workpiece W constant during processing operation. This configuration can avoid the machine tool 5 from bringing the polishing device 1 closer to the workpiece W although the total length of the wire-shaped grinding element 2 is excessively short. This can prevent the sleeve 7 of the polishing device 1 from touching the workpiece W or another member located near the workpiece W, that is, an interference accident.

In the present embodiment, the sleeve 7 has the groove 31 extending in the axis L direction. On the other hand, the joint member 24 has the protrusion 32 protruding toward the outer periphery and inserted in the groove 31. In this configuration, the sleeve 7 guides the joint member 24 in the axis L direction. The groove 31 of the sleeve 7 and the protrusion 32 of the joint member 24 constitute the rotation restricting mechanism 40 that restricts co-rotation of the joint member 24 and the shaft member 36. Accordingly, the joint member 24 (polishing brush 3) can be moved accurately in the axis L direction when the motor 35 (movement mechanism 22) is actuated.

In the present embodiment, the polishing brush holder 4 has the sleeve 7, which can define the amount of flexion by which the wire-shaped grinding elements 14 of the polishing brush 3 are flexed toward the outer periphery when the polishing device 1 is rotated.

In the present embodiment, the control unit 51 transmits the number of times of movement of the polishing brush 3 counted by the counter 54 to an external device through the wireless communication unit 55. The external device receiving the number of times of movement therefore can grasp the wear state of the wire-shaped grinding element 2 of the polishing brush 3 based on the number of times of movement. The time for replacement of the polishing brush 3 thus can be grasped.

In the present embodiment, the control unit 51 transmits the output (sensor detection pressure P) from the pressure sensor 53 to an external device through the wireless communication unit 55. The external device thus can grasp the state of load by monitoring the state of load exerted on the polishing brush 3 from the workpiece W. Here, if the state of load exerted on the polishing brush 3 from the workpiece W can be grasped, it is possible to grasp the processing state in the preceding step performed on the workpiece W before the polishing step by the polishing device 1, for example, such a state as the size of burrs produced in the preceding step.

In the present embodiment, the polishing brush holder 4 includes the motor battery 57 and the control battery 58. This configuration eliminates the need for externally supplying power to the polishing brush holder 4. The polishing device 1 thus can be easily rotated while being connected to the spindle 5*a* of the machine tool 5.

(Modifications)

The motor battery 57 and the control battery 58 may be those wirelessly rechargeable. The motor battery 57 and the control battery 58 are removable from the polishing brush holder 4 and can be replaced. The motor battery 57 and the control battery 58 are not necessarily held in the polishing brush holder 4 but may be supplied with power from the outside. The motor battery 57 and the control battery 58 may be a single battery to be supplied with power from the same power source.

The wireless communication unit 55 can perform communication between an external device and the control unit 51 via infrared communication or Bluetooth (registered trademark).

In the example above, the rotation restricting mechanism 40 that restricts relative rotation of the joint member 24 and the sleeve 7 around the axis L is configured with the recess provided on the inner peripheral surface 7*b* of the sleeve 7 and the protrusion 32 provided on the outer peripheral surface of the joint member 24. However, the configuration of the rotation restricting mechanism 40 is not limited to this. For example, the sleeve 7 may have a protrusion 32 protruding toward the inner periphery and extending in the axis L direction on its inner peripheral surface 7*b*, and the joint member 24 may have a groove 31 extending in the axis L direction on the facing surface 25*a* facing the inner peripheral surface 7*b* of the sleeve 7. In this case, the rotation restricting mechanism 40 is configured such that the joint member 24 is disposed in the sleeve 7 with the protrusion 32 of the sleeve 7 inserted in the groove 31. For example, the rotation restricting mechanism 40 may be configured such that the sleeve 7 is shaped in a rectangular tube and the grinding element holder 11 of the polishing brush 3 is shaped in a polygon corresponding to the shape of the sleeve 7 as viewed from the axis L direction.

A direct drive mechanism may be employed, in which the motor 35 directly actuates the shaft member 36. In this case, the rotor (output shaft) of the motor 35 is coaxially connected to the back side L2 of the shaft member 36. The drive force-transmitting mechanism 38 is a connection member that connects the rotor (output shaft) of the motor 35 to the shaft member 36. In this case, the rotor is supported movably in the axis L direction in the motor 35, and the pressure sensor 53 is directly in contact with the rotor from the back side L2. The pressure sensor 53 detects the pressure exerted on the rotor of the motor 35 as a load exerted on the polishing brush 3 from the workpiece W.

In place of the pressure sensor 53, a vibration detector that detects vibration of the polishing brush 3 supported by the support mechanism 21 may be used as a load detector. Specifically, since the machine tool 5 brings the front end of the wire-shaped grinding element 2 of the polishing brush 3 into contact with the workpiece W during processing operation, the vibration of the polishing brush 3 changes with change in load exerted on the polishing brush 3 from the workpiece W. The load exerted on the polishing brush 3 from the workpiece W thus can be detected using a vibration detector. For example, when the polishing brush 3 becomes excessively worn during processing operation and the position of the front end 2*a* of the wire-shaped grinding element 2 moves in a direction away from the workpiece W, the vibration of the polishing brush 3 decreases as the load exerted on the polishing brush 3 from the workpiece W decreases. On the other hand, if the movement mechanism 22 is actuated to move the polishing brush 3 to the front side L1, the vibration of the polishing brush 3 increases as the depth of cut increases and the load exerted on the polishing brush 3 from the workpiece W increases. Here, the vibration detector can detect the vibration of the polishing brush 3, for example, by detecting the vibration of the back end of the shaft member 36.

In place of the pressure sensor 53, an acoustic wave detector that detects the amplitude of sound produced in the polishing brush 3 supported by the support mechanism 21 may be used as the load detector. Specifically, since the machine tool 5 brings the front end of the wire-shaped grinding element 2 of the polishing brush 3 into contact with the workpiece W during processing operation, the vibration of the polishing brush 3 changes with change in load exerted on the polishing brush 3 from the workpiece W. When the vibration of the polishing brush 3 changes, the amplitude of sound produced in the polishing brush 3 changes. The load exerted on the polishing brush 3 from the workpiece W thus can be detected using an acoustic wave detector. For example, when the polishing brush 3 becomes excessively worn during processing operation and the position of the front end 2*a* of the wire-shaped grinding element 2 moves in a direction away from the workpiece W, the vibration of the polishing brush 3 decreases as the load exerted on the polishing brush 3 from the workpiece W decreases. The amplitude of sound produced in the polishing brush 3 decreases, accordingly. On the other hand, if the movement mechanism 22 is actuated to move the polishing brush 3 to the front side L1, the vibration of the polishing brush 3 increases as the depth of cut increases and the load exerted on the polishing brush 3 from the workpiece W increases. The amplitude of sound produced in the polishing brush 3 increases, accordingly.

Second Embodiment

Figure 7:
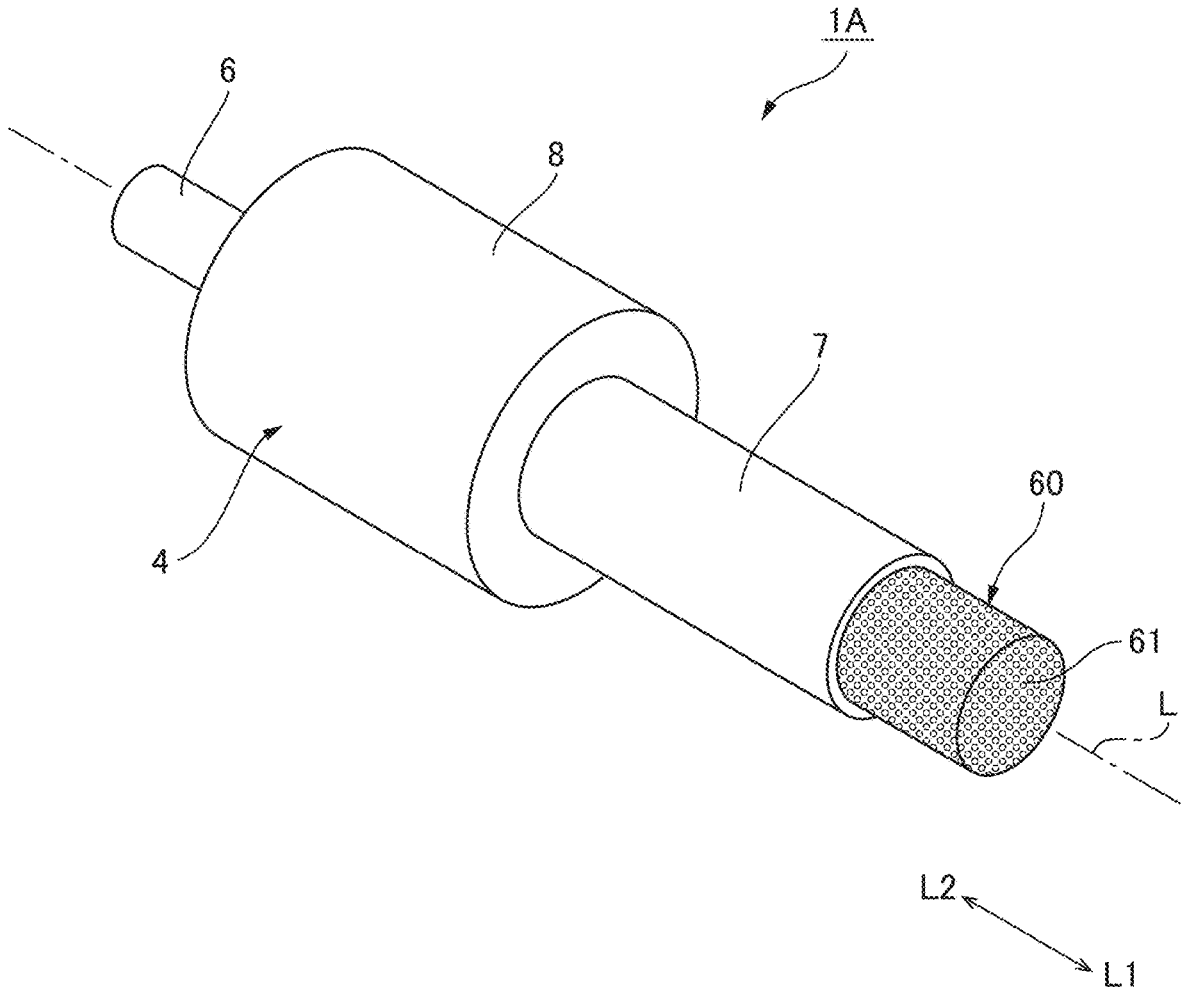
FIG. 7 is a perspective view of a polishing device in a second embodiment to which the present invention is applied.
Figure 8:
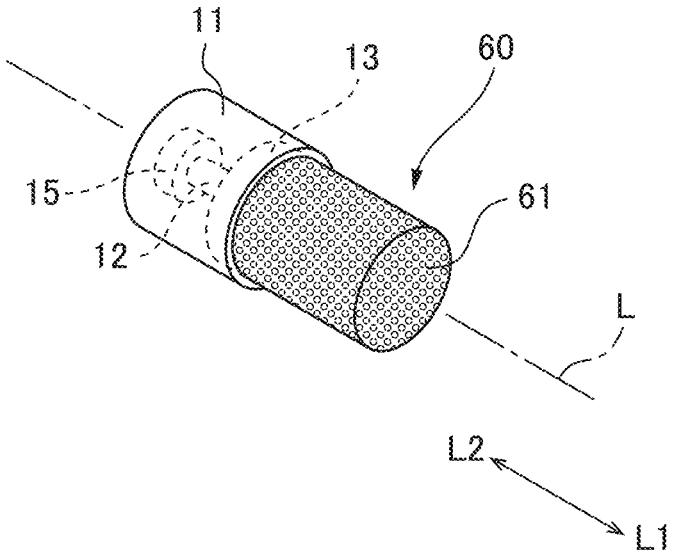
FIG. 8 is a perspective view of a polishing tool of the polishing device in the second embodiment.

FIG. 7 is an external perspective view of a polishing device in a second embodiment to which the present invention is applied. FIG. 8 is a perspective view of a polishing tool of the polishing device in the second embodiment. A polishing tool 60 of a polishing device 1A in the second embodiment includes an elastic grinder 61 as a grinding element and does not include the wire-shaped grinding elements 14. The polishing device 1A has a configuration corresponding to the polishing device 1 in the first embodiment, and the corresponding configuration is denoted by the same reference sign and will not be further elaborated.

As illustrated in FIG. 7, the polishing device 1A includes a polishing tool 60 and a polishing tool holder 4 removably holding the polishing tool 60. As illustrated in FIG. 8, the polishing tool 60 includes a grinding element holder 11 and an elastic grinder 61 held in the grinding element holder 11. The polishing tool holder 4 has the same configuration as the polishing brush holder 4 of the polishing device 1 in the first embodiment.

(Polishing Tool)

As illustrated in FIG. 8, the polishing tool 60 has the cylindrical elastic grinder 61 extending in the axis L direction, as the grinding element. The grinding element holder 11 holds a one-side end in the axis L direction of the elastic grinder 61. The elastic grinder 61 includes an elastic foam, a polymer, and abrasive grains. In the present embodiment, the elastic foam is a melamine resin foam. In the present embodiment, the elastic foam is an anisotropic elastic foam that is compressed in one direction to impart anisotropy to elastic force.

The base material of the elastic grinder 61 is obtained by sintering the anisotropic elastic foam impregnated with a dispersion liquid containing a polymer and abrasive grains. The direction with the strongest elastic force in the anisotropic elastic foam is the compression direction. The elastic grinder 61 is formed such that the compression direction of the anisotropic elastic foam agrees with the axis L direction when the polishing tool 60 is held in the polishing tool holder 4.

The polymer functions as a binder. The polymer is one of epoxy-based resins, urethane-based resins, polyester-based resins, or polyrotaxane. In the present embodiment, the polymer is polyrotaxane. The abrasive grains are selected as appropriate depending on the kind of workpiece. Diamond, alumina, silica, silicon carbide, silicon nitride, boron carbide, titania, cerium oxide, or zirconia can be used as the abrasive grains. The grinding element is an organic substance such as walnut and synthetic resins. In the present embodiment, the abrasive grains are alumina.

The elastic grinder 61 in the present embodiment satisfies the following condition:

bonding force between polymer and abrasive grains>internal bonding force of anisotropic elastic foam and polymer>internal bonding force of anisotropic elastic foam.

In the elastic grinder 61 satisfying such a condition, the anisotropic elastic foam with the smaller internal bonding force drops first, during the processing operation, and the polymer and the abrasive grains with the bonding force larger than the anisotropic elastic foam are exposed at a constant rate. The polymer and the abrasive grain then drop, and the anisotropic elastic foam is exposed. Here, the anisotropic elastic foam easily drops, and the polymer and the abrasive grains are exposed again at a constant rate. Consequently, the rate at which the polymer and the abrasive grain are exposed is kept in a certain range in the elastic grinder 61. Accordingly, precise surface accuracy can be achieved by the processing operation by the elastic grinder 61.

As illustrated in FIG. 8, the grinding element holder 11 is an annular member having a holder through hole 12 extending in the axis L direction. The grinding element holder 11 has a circular grinding element-holding recess 13 surrounding the holder through hole 12 on its front end surface. The holder through hole 12 has a front end opening at the center of the circular bottom surface of the grinding element-holding recess 13. The back end portion in the axis L direction of the elastic grinder 61 is inserted in the grinding element-holding recess 13 and fixed to the grinding element holder 11 by adhesive. The grinding element holder 11 has a recess surrounding the holder through hole 12 at its front end surface. The recess is a polishing tool-side joint portion 15 for removably attaching the polishing tool 60 to the polishing tool holder 4.

The polishing tool 60 has the polishing tool-side joint portion 15 attached to a joint portion (protrusion 26) of the joint member 24 of the polishing tool holder 4. With this configuration, the polishing tool 60 is supported by the support mechanism 21 of the polishing tool holder 4 so as to be movable in the axis L direction. The polishing tool 60 is supported by the support mechanism 21 in such a posture that the grinding element holder 11 is located inside the sleeve 7 and the front end of the elastic grinder 61 protrudes from the sleeve 7. When the polishing tool 60 is attached to the joint member 24, the through hole 28 of the joint member 24 is communicatively connected with the holder through hole 12.

In a state in which the polishing tool 60 is supported by the support mechanism 21, the shaft member 36 of the movement mechanism 22 passes through the through hole 28 of the joint member 24 inside the sleeve 7. The front end portion of the shaft member 36 is inserted in the holder through hole 12 of the polishing brush 3 attached to the joint member 24.

Here, the control operation in which the control unit 51 of the polishing tool holder 4 moves the polishing tool 60 during processing operation of cutting or polishing a workpiece W by the polishing device 1A is similar to the control operation in which the control unit 51 of the polishing brush holder 4 moves the polishing brush 3 in the polishing device 1 in the first embodiment.

(Operation Effects)

The polishing device 1A in the present embodiment achieves operation effects similar to the polishing device 1 in the first embodiment.

Specifically, also in the present embodiment, since the polishing tool holder 4 includes the pressure sensor 53, the load (pressure) exerted on the polishing tool 60 from the workpiece W can be detected during processing operation in which the polishing device 1A connected to the machine tool 5 cuts or polishes the workpiece W. The control unit 51 of the polishing tool holder 4 actuates the movement mechanism 22 to move the polishing tool 60 in the axis L direction, based on the output (sensor detection pressure P) from the pressure sensor 53. With this configuration, even when the elastic grinder 61 of the polishing tool 60 is worn, the polishing device 1A can maintain the processing accuracy in polishing or cutting the workpiece W. It is therefore unnecessary to allow the machine tool 5 to perform complicated control operation such as moving the polishing device 1A in a direction closer to the workpiece W as the elastic grinder 61 is worn. Accordingly, complication of the control program for controlling the machine tool 5 can be avoided. According to the present embodiment, the processing accuracy for the workpiece W can be maintained even in such a case where, when the processing starts with the distance D between the spindle 5*a* and the workpiece W being kept constant, the distance D between the spindle 5*a* and the workpiece W is short, for example, due to a dimension error of the workpiece W to cause excessive processing on the workpiece W.

In the present embodiment, the grinding element (elastic grinder 61) of the polishing tool 3 has elasticity. Breakage of the grinding element of the polishing tool 3 therefore can be prevented or suppressed when the polishing tool holder 4 moves the polishing tool 3 in a direction closer to the workpiece W to increase the depth of cut on the workpiece W. Here, the elastic grinder 61 may include abrasive grains and a binder such as rubber. The elastic grinder 61 may include abrasive grains and a binder such as epoxy resin.

In the present embodiment, the polishing tool holder 4 has the sleeve 7, which can define the amount of flexion by which the elastic grinder 61 of the polishing tool 3 is flexed toward the outer periphery when the polishing device 1A is rotated.

The polishing device 1A in the present embodiment also can employ modifications to the polishing device 1 in the first embodiment.

Third Embodiment

Figure 9:
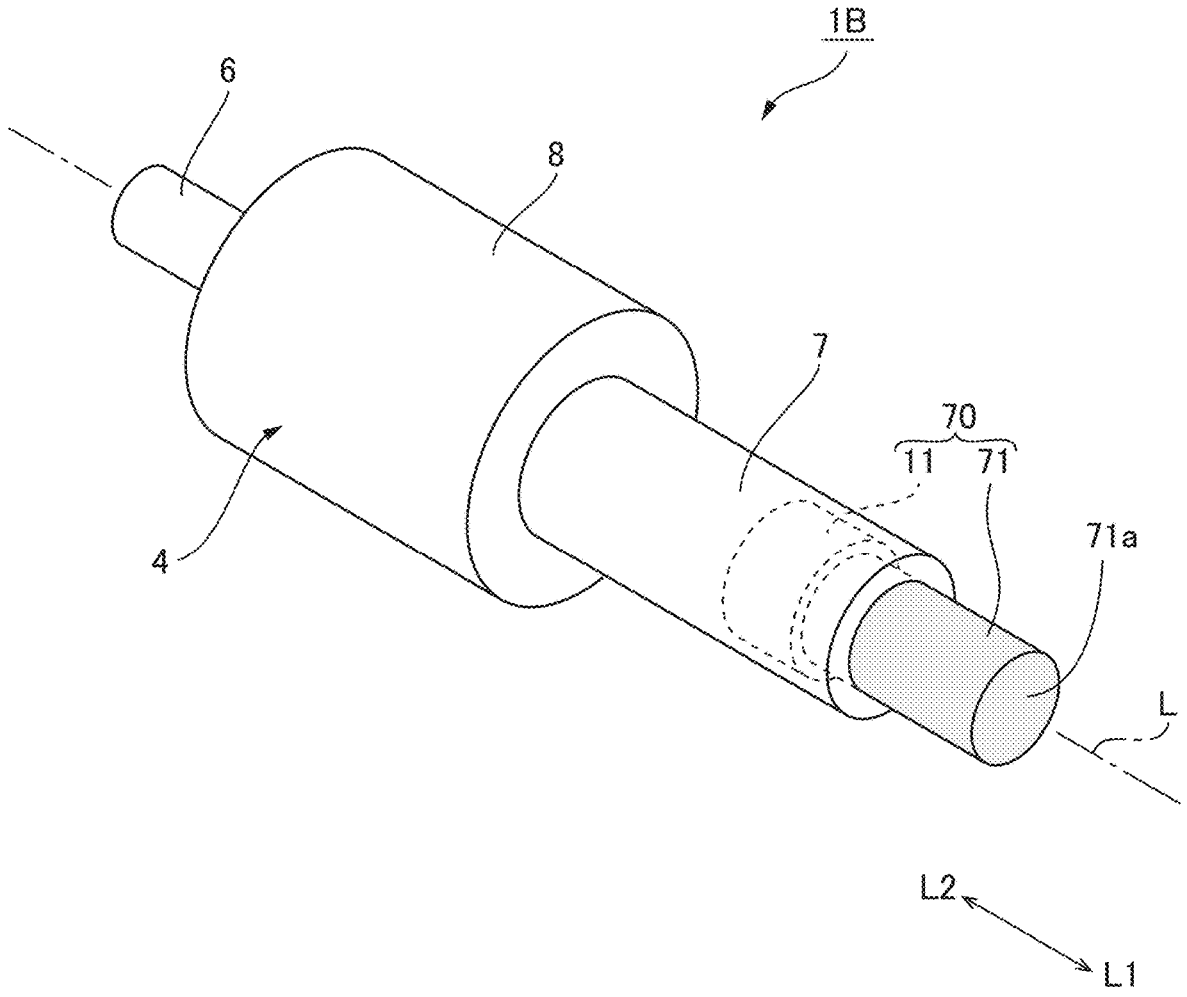
FIG. 9 is a perspective view of a polishing device in a third embodiment to which the present invention is applied.

FIG. 9 is a perspective view of a polishing device in a third embodiment. In a polishing device 1B in the present embodiment, the grinding element of the polishing tool 60 of the polishing device 1A in the second embodiment is changed from the elastic grinder 61 to a rigid grinder 71. As illustrated in FIG. 9, the polishing device 1B includes a polishing tool 70 and a polishing tool holder 4 removably holding the polishing tool 70. The polishing tool 70 includes a grinding element holder 11 and a rigid grinder 71 held in the grinding element holder 11. The grinder 71 is abrasive grains bonded by a binder such as vitrified binder, or a natural grinder. The grinder 71 has a cylindrical shape extending in the axis L direction. In the polishing device 1B, the configuration is the same as the polishing device 1A in the second embodiment, except the grinder 71. In the polishing device 1B, the configuration corresponding to the polishing device 1A is denoted by the same reference sign and will not be further elaborated.

(Operation Effects)

The polishing device 1B in the present embodiment achieves operation effects similar to the polishing device 1 in the first embodiment.

Specifically, also in the present embodiment, since the polishing tool holder 4 includes the pressure sensor 53, the load (pressure) exerted on the polishing tool 70 from the workpiece W can be detected during processing operation in which the polishing device 1B connected to the machine tool 5 cuts or polishes the workpiece W. The control unit 51 of the polishing tool holder 4 actuates the movement mechanism 22 to move the polishing tool 70 in the axis L direction, based on the output (sensor detection pressure P) from the pressure sensor 53. With this configuration, even when the grinder 71 of the polishing tool 70 is worn, the polishing device 1B can maintain the processing accuracy in polishing or cutting the workpiece W. It is therefore unnecessary to allow the machine tool 5 to perform complicated control operation such as moving the polishing device 1B in a direction closer to the workpiece W as the grinder 71 is worn. Accordingly, complication of the control program for controlling the machine tool 5 can be avoided. According to the present embodiment, the processing accuracy for the workpiece W can be maintained even in such a case where, when the processing starts with the distance D between the spindle 5*a* and the workpiece W being kept constant, the distance D between the spindle 5*a* and the workpiece W is short, for example, due to a dimension error of the workpiece W to cause excessive processing on the workpiece W.

Here, in the present embodiment, since the grinding element of the polishing tool 70 is the rigid magnet 71, the excessive depth of cut set for the workpiece W may cause breakage of the magnet 71. When the processing operation is started using the polishing device 1B in the present embodiment, first, the polishing tool 70 is arranged at the rearmost position on the back side L2 in the axis L direction in a movable range of the polishing tool 70. With this, a front end surface 71*a* of the grinder 71 is not in contact with a workpiece when the machine tool 5 sets the distance D between the spindle 5*a* and the workpiece W (see FIG. 4).

Next, the control unit 51 actuates the motor 35 to move the polishing tool 3 to the front side L1. The control unit 51 then monitors the output (sensor detection pressure P) from the pressure sensor 53 when moving the polishing tool 3 and stops actuating the motor 35 based on the monitored output to stop moving the polishing tool 3. That is, the control unit 51 stops actuating the motor 35 to stop moving the polishing tool 3 when it is detected that the front end surface 71*a* of the grinder 71 is in contact with the workpiece W based on the output from the pressure sensor 53. This can avoid the excessive depth of cut on the workpiece W by the polishing tool 3, thereby preventing or suppressing breakage of the grinder 71 in processing operation.

The polishing device 1B in the present embodiment also can employ modifications to the polishing device 1 in the first embodiment.

Other Embodiments

In the above polishing devices 1 to 1B, the polishing tool holder 4 includes the sleeve 7 as a guide member for guiding the joint member 24 in the axis L direction. However, the guide member is not limited to the tubular sleeve 7. For example, four cylinders extending along the axis L may be arranged at equiangular intervals on the outer peripheral side of the joint member 24 to serve as a guide member alternative to the sleeve 7.

In this case, the guide member has a gap between two cylinders adjacent in the circumferential direction to serve as a groove 31 extending in the axis L direction. With this configuration, the protrusion 32 of the joint member 24 is inserted in the groove 31, whereby the joint member 24 is guided along the groove 31 when the joint member 24 moves in the axis L direction. The groove 31 and the protrusion 32 of the joint member 24 constitute the rotation restricting mechanism 40 that restricts co-rotation of the joint member 24 and the shaft member 36. Accordingly, the joint member 24 can be moved accurately in the axis L direction when the motor 35 (movement mechanism 22) is actuated.

In a case where the polishing tool holder 4 does not have a sleeve 7, the machine tool 5 performs processing operation with the distance D between the spindle 5*a* and the workpiece W being kept constant.

The invention claimed is:

1. A polishing tool holder configured to removably hold a polishing tool having a grinding element holder and a grinding element held in the grinding element holder, the polishing tool holder comprising:

a shank connected to a machine tool;

a support mechanism configured to support the polishing tool movably in an axis direction of the shank;

a movement mechanism including a drive source to move the polishing tool in the axis direction;

a load detector configured to detect a load exerted on the polishing tool from a workpiece when the polishing tool supported by the support mechanism is polishing the workpiece; and a control unit configured to actuate the movement mechanism based on an output from the load detector to move the polishing tool in the axis direction.

2. The polishing tool holder according to claim 1, wherein when it is determined that the load exerted on the polishing tool from the workpiece becomes lower than a predetermined setting load based on the output from the load detector, the control unit actuates the movement mechanism to move the polishing tool in a direction closer to the workpiece.

3. The polishing tool holder according to claim 1, wherein when it is determined that the load exerted on the polishing tool from the workpiece becomes higher than a predetermined setting load based on the output from the load detector, the control unit actuates the movement mechanism to move the polishing tool in a direction away from the workpiece.

4. The polishing tool holder according to claim 1, wherein the control unit monitors the output from the load detector when actuating the movement mechanism and stops actuating the movement mechanism based on the output to stop moving the polishing tool.

5. The polishing tool holder according to claim 1, wherein, the load detector is a pressure sensor configured to detect a pressure in the axis direction exerted on the polishing tool supported by the support mechanism.

6. The polishing tool holder according to claim 1, wherein the load detector is a vibration detector configured to detect vibration of the polishing tool supported by the support mechanism.

7. The polishing tool holder according to claim 1, wherein the load detector is an acoustic wave detector configured to detect an amplitude of sound produced in the polishing tool supported by the support mechanism.

8. The polishing tool holder according to claim 1, wherein the polishing tool holder includes a counter configured to count a number of times of movement every time the control unit actuates the movement mechanism to move the polishing tool in a direction closer to the workpiece.

9. The polishing tool holder according to claim 1, wherein the polishing tool holder includes:

a first power source configured to supply power to the drive source of the movement mechanism; and a second power source configured to supply power to the control unit.

10. The polishing tool holder according to claim 1, wherein the polishing tool holder include a wireless communication unit configured to transmit the output from the load detector to outside an external device.

11. The polishing tool holder according to claim 1, wherein the polishing tool holder includes a wireless communication unit configured to perform communication between the control unit and an external device.

12. The polishing tool holder according to claim 5, wherein the support mechanism has a joint member to which the grinding element holder is coupled, the joint member has a through hole passing through in the axis direction, a female screw is disposed on an inner peripheral surface of the through hole, the movement mechanism includes:

a motor serving as the drive source;

a shaft member extending so as to pass through the through hole;

a drive force-transmitting mechanism configured to transmit rotation of the motor to the shaft member;

a male screw disposed on an outer peripheral surface of the shaft member and threaded in the female screw; and a rotation restricting mechanism configured to restrict co-rotation of the joint member and the shaft member, and the control unit is configured to rotate the shaft member by actuation of the motor and move the joint member in the axis direction.

13. The polishing tool holder according to claim 12, wherein the support mechanism includes a guide member configured to guide the joint member in the axis direction on an outer periphery side of the joint member, the guide member has a groove extending in the axis direction, the joint member has a protrusion protruding toward the outer periphery side and disposed in the groove, and the rotation restricting mechanism includes: the groove; and the protrusion.

14. The polishing tool holder according to claim 13, wherein the guide member is a tubular sleeve extending coaxially to the shank, and the support mechanism supports the polishing tool such that the grinding element holder is located inside the sleeve and a part of the grinding element protrudes from the sleeve.

15. The polishing tool holder according to claim 12, wherein the movement mechanism includes a support member configured to support the shaft member movably in the axis direction and rotatably around the axis, the support member is located between the joint member and the drive force-transmitting mechanism in the axis direction, the drive force-transmitting mechanism includes:

a final gear configured to rotate around a rotation axis parallel to the shaft member;

a driving force of the motor being transmitted to the final gear;

an output gear fixed coaxially to the shaft member and meshed with the final gear; and a biasing member configured to bias the output gear toward the support member, and the pressure sensor is in contact with the shaft member from the axis direction to detect a pressure exerted on the shaft member.

16. A polishing device comprising:

the polishing tool holder according to claim 1; and the polishing tool, wherein the grinding element includes a plurality of wire- shaped grinding elements disposed side by side with a length direction oriented in the axis direction, the grinding element holder holds one-side ends in the axis direction of the wire-shaped grinding elements, the polishing tool is held in the polishing tool holder and brings the other-side ends of the wire-shaped grinding elements into contact with a workpiece to polish the workpiece.

17. A polishing device comprising:

the polishing tool holder according to claim 1; and the polishing tool, wherein the grinding element is an elastic grinder, the grinding element holder holds a one-side end in the axis direction of the elastic grinder, and the polishing tool is held in the polishing tool holder and brings the other-side end of the elastic grinder into contact with a workpiece to polish the workpiece.

18. The polishing tool holder according to claim 17, wherein the elastic grinder includes:

an elastic foam;

a polymer; and abrasive grains.

19. A polishing device comprising:

the polishing tool holder according to claim 1; and the polishing tool, wherein the grinding element is a rigid grinder, the grinding element holder holds a one-side end in the axis direction of the grinding element, and the polishing tool is held in the polishing tool holder and brings the other-side end of the grinding element into contact with a workpiece to polish the workpiece.

* * * * *